US008602727B2

(12) United States Patent
Bahadur

(10) Patent No.: US 8,602,727 B2
(45) Date of Patent: Dec. 10, 2013

(54) TURBINE NOZZLE SEGMENT HAVING ARCUATE CONCAVE LEADING EDGE

(75) Inventor: Bala Muralidhar Singh Bahadur, Bangalore (IN)

(73) Assignee: General Electric Company, Schenectady, NY (US)

( * ) Notice: Subject to any disclaimer, the term of this patent is extended or adjusted under 35 U.S.C. 154(b) by 749 days.

(21) Appl. No.: 12/841,365

(22) Filed: Jul. 22, 2010

(65) Prior Publication Data

US 2012/0020804 A1 Jan. 26, 2012

(51) Int. Cl.
*F01D 5/14* (2006.01)

(52) U.S. Cl.
USPC ..... 415/192; 415/211.2

(58) Field of Classification Search
USPC ..... 415/191, 192, 211.2
See application file for complete search history.

(56) References Cited

U.S. PATENT DOCUMENTS

| | | | | |
|---|---|---|---|---|
| 5,482,433 | A * | 1/1996 | Norris et al. | 415/173.7 |
| 6,079,948 | A * | 6/2000 | Sasaki et al. | 416/237 |
| 6,398,489 | B1 | 6/2002 | Burdgick et al. | |
| 6,491,493 | B1 | 12/2002 | Watanabe et al. | |
| 6,508,630 | B2 * | 1/2003 | Liu et al. | 416/228 |
| 7,086,829 | B2 * | 8/2006 | Fuller et al. | 415/115 |
| 7,758,306 | B2 * | 7/2010 | Burton et al. | 415/209.1 |

* cited by examiner

*Primary Examiner* — Nathaniel Wiehe
*Assistant Examiner* — Woody A Lee, Jr.
(74) *Attorney, Agent, or Firm* — Hoffman Warnick LLC; Ernest G. Cusick

(57) ABSTRACT

Turbine nozzle segments with trimmed leading edges are disclosed. In one embodiment of the invention, a turbine static nozzle airfoil includes: an arcuate concave leading edge; and a substantially flat trailing edge.

10 Claims, 5 Drawing Sheets

TURBINE NOZZLE SEGMENT HAVING ARCUATE CONCAVE LEADING EDGE

BACKGROUND OF THE INVENTION

The subject matter disclosed herein relates to a turbine nozzle assembly. Specifically, the subject matter disclosed herein relates to a turbine nozzle assembly including a plurality of nozzle segments with arcuate concave leading edges.

Turbines (e.g., steam turbines or gas turbines) include static nozzle (or "airfoil") segments that direct flow of a working fluid into turbine buckets connected to a rotating rotor. A complete assembly of nozzle segments is sometimes referred to as a diaphragm stage (e.g., a diaphragm stage of a steam turbine), where a plurality of stages form a diaphragm assembly. The diaphragm assembly is configured to surround the turbine buckets, and the flow path defined by the static nozzle segments in the assembly may affect the efficiency of the turbine.

BRIEF DESCRIPTION OF THE INVENTION

Turbine nozzle segments with arcuate concave leading edges are disclosed. In one embodiment of the invention, a turbine static nozzle airfoil includes: an arcuate concave leading edge; and a substantially flat trailing edge.

A first aspect of the invention provides for a turbine static nozzle airfoil including: an arcuate concave leading edge; and a substantially flat trailing edge.

A second aspect of the invention includes a turbine static nozzle blade assembly comprising: an airfoil having an arcuate concave leading edge; a first sidewall integral with a first side of the leading edge; and a second sidewall integral with a second side of the leading edge.

A third aspect of the invention includes an apparatus comprising: a turbine assembly having: a casing; a turbine rotor at least partially surrounded by the casing; and a diaphragm assembly at least partially surrounding the turbine rotor and at least partially surrounded by the casing, the diaphragm assembly including an annulus of static nozzle blades, wherein each of the static nozzle blades includes an airfoil having an arcuate concave leading edge.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention may not be to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As indicated above, aspects of the invention provide for turbine nozzle segments with arcuate concave leading edges.

In one embodiment of the invention, a turbine static nozzle airfoil includes: an arcuate concave leading edge. In one embodiment, the arcuate concave leading edge may have an arc radius of approximately three-quarters of the radial height to approximately four-thirds of the radial height. For example, where the radial height (h) is approximately 4 inches, the arc radius may be approximately 3 inches. In another example, where the radial height (h) is approximately 12 inches, the arc radius may be approximately 15 inches. It is understood that other relationships between the radial height and arc radius are also possible. In one embodiment, the trailing edge may be substantially flat. In another embodiment, the trailing edge may be substantially arcuate convex.

Figure 1:
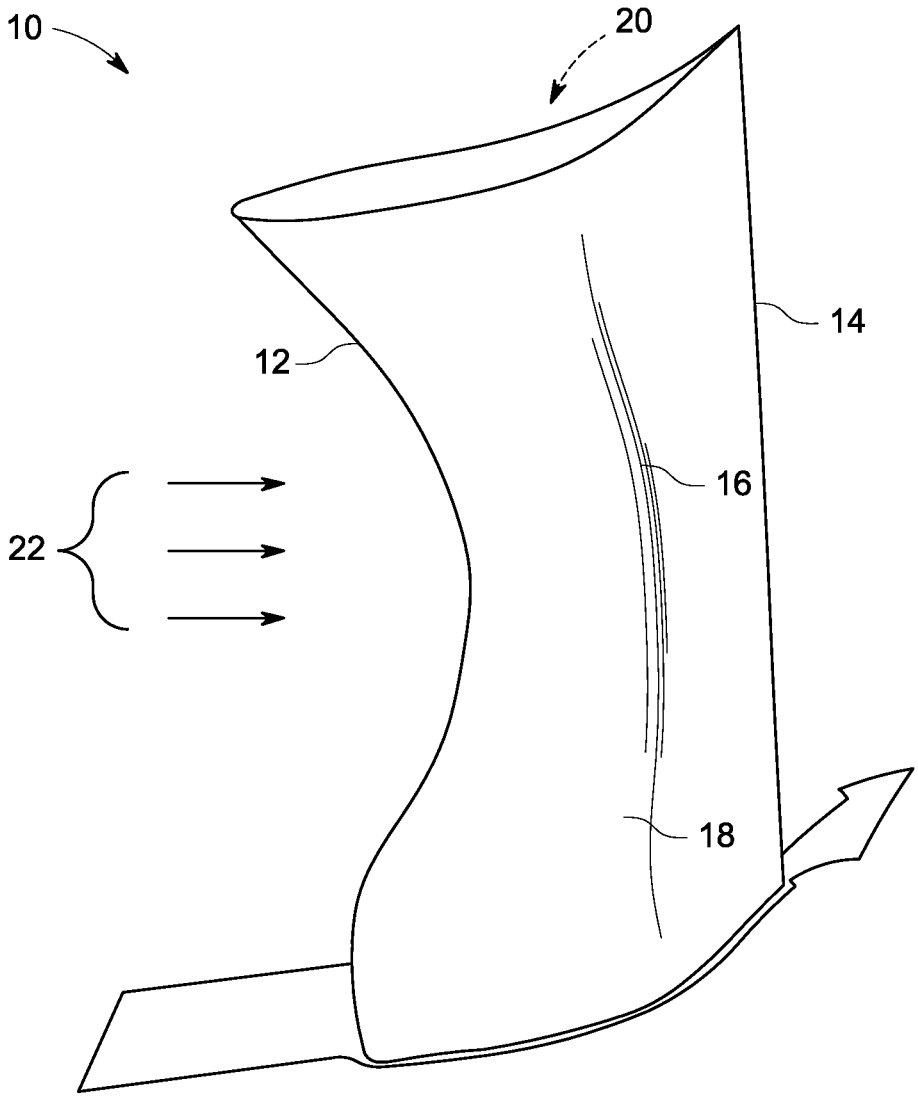
FIGS. 1-3 show three-dimensional perspective views of a static turbine airfoil according to embodiments of the invention.

Turning to the FIG. 1, a three-dimensional perspective view of a static nozzle airfoil 10 is shown according to an embodiment. In one embodiment, static nozzle airfoil 10 may include an arcuate concave leading edge 12 and a trailing edge 14 opposing the arcuate concave leading edge 12. In one embodiment, trailing edge 14 may be a substantially flat trailing edge. In another embodiment, trailing edge 14 may be substantially arcuate convex (not shown), as is known in the art. Static nozzle airfoil 10 may further include a body portion 16 located between leading edge 12 and trailing edge 14. Body portion 16 may include a suction side 18 and a pressure side 20 opposing suction side 18 (and not visible from this perspective). As is known in the art of fluid mechanics/aerodynamics, as a fluid flows across static nozzle airfoil 10, a greater fluid pressure is built up along pressure side 20 than across suction side 18, due to the arcuate nature of body portion 16. Static nozzle airfoil 10 may include a metal such as, steel, and/or may include one or more of silicon, nickel, carbon, manganese, or steel (e.g., AISI B50A365B steel or AISI B50A332B steel) and may be formed by casting or other conventional techniques.

As shown in FIG. 1, static nozzle airfoil 10, and in particular, leading edge 12 is configured to guide a working fluid (e.g., a gas or steam, indicated by arrows 22) toward trailing edge 14 across body portion 16. In particular, during operation of a turbine (discussed further herein) working fluid 22 may be guided by leading edge 12 across pressure side 20 of body portion 16. As is illustrated further herein, leading edge 12 may guide working fluid 22 toward one or more dynamic turbine blades (not shown) to aid a turbine in performing its designed functions (e.g., performing mechanical work on a rotating shaft).

Figure 2:
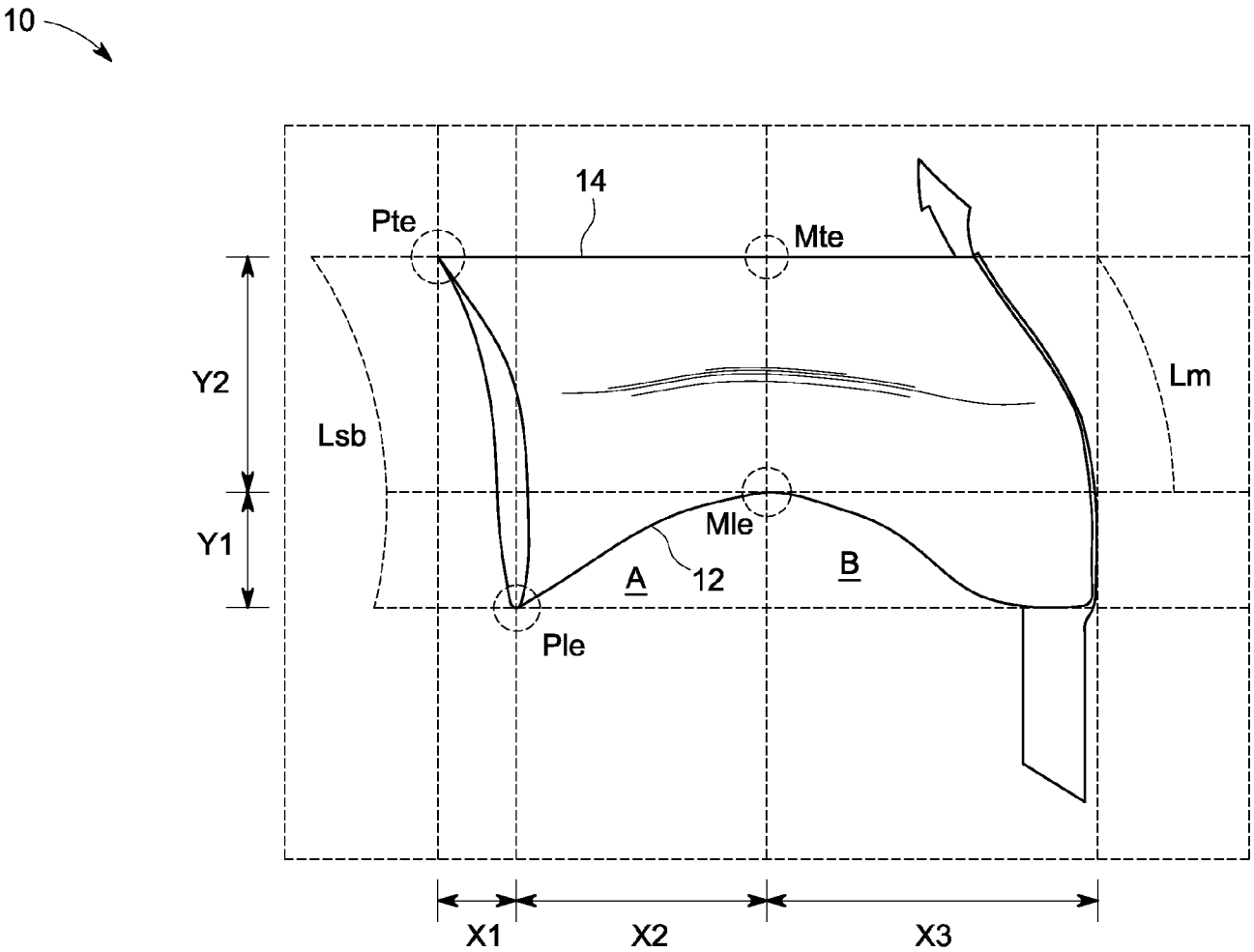

Turning to FIG. 2, another three-dimensional perspective view of a static nozzle airfoil 10 is shown according to an embodiment. This view illustrates dimensional aspects of static nozzle airfoil 10 according to embodiments, with some labeling omitted for clarity (e.g., body 16). A grid illustrating dimensional relationships between portions of static nozzle airfoil 10 includes intersections (points, indicated by dashed circles) such as a midpoint (Mle) of leading edge 12, a midpoint (Mte) of trailing edge 14, a peripheral point (Ple) of leading edge 12 and a peripheral point (Pte) of trailing edge 14. Also illustrated in FIG. 2 is a length (Lsb) of an arc extending across the suction side 18 of body portion 16. This length (Lsb) may represent the approximate distance from leading edge peripheral point (Ple) to trailing edge peripheral point (Pte) along body portion 16. Additionally shown in FIG. 2 is a length (Lm) of an arc extending from leading edge midpoint (Mle) across the suction side 18 of body portion 16 to trailing edge midpoint (Mte). In one embodiment, a distance measured along body portion 16 from leading edge midpoint (Mle) to trailing edge midpoint (Mte) is less than a distance measured along body portion 16 from leading edge peripheral point (Ple) to trailing edge peripheral point (Pte).

The y-component of these distances is represented in FIG. 2 as (y2) and (y1+y2), respectively. That is, the difference in the y-component of distances Lm and Lsb is equal to (y1). This result is obtained whether measuring across suction side 18 or pressure side 20 of body portion 16. In any case, Lm is smaller than Lsb.

In contrast to conventional static nozzle airfoils, static nozzle airfoil 10 shown according to embodiments of the invention includes an arcuate concave leading edge 12. Conventional static nozzle airfoils may include substantially flat or planar leading edges, or those being substantially arcuate convex. For example, in contrast to static nozzle airfoil 10 in FIG. 2, a conventional static nozzle airfoil shown in this coordinate arrangement would occupy regions (A) and (B) shown as void. That is, static nozzle airfoil 10 includes a substantially arcuate void (defined by regions A and B) absent in conventional static nozzle airfoils. The arcuate concave leading edge 12 of static nozzle airfoil 10 may allow for reduced flow loss as compared to conventional static nozzle airfoils, and may contribute to increase turbine efficiency of a turbine system utilizing such airfoils.

Figure 3:
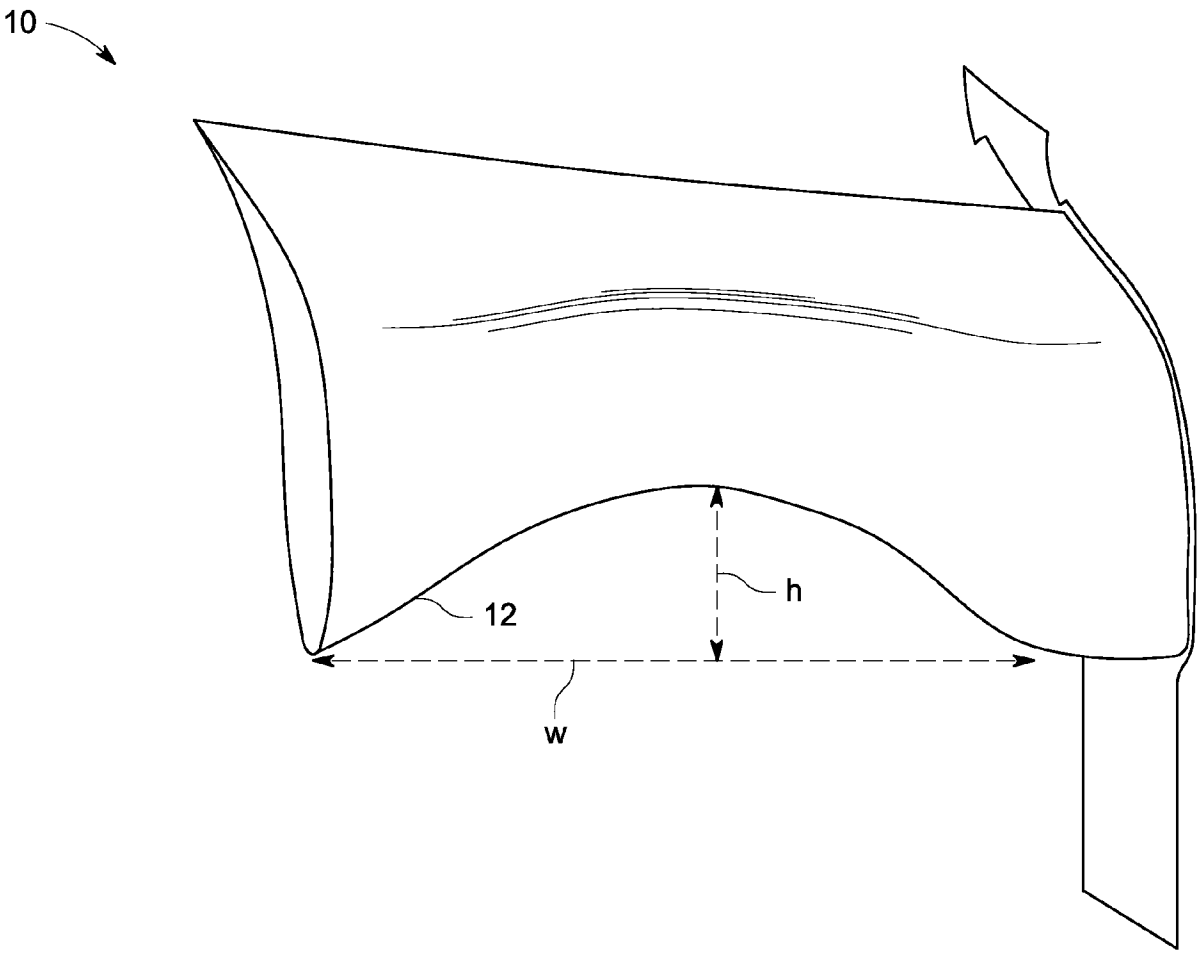

Turning to FIG. 3, in one embodiment, static nozzle airfoil 10 has an arcuate concave leading edge 12 with an arc radius of approximately three-quarters of the radial height (h) to approximately four-thirds of the radial height (h). For example, where the radial height (h) is approximately 4 inches, the arc radius may be approximately 3 inches. In another example, where the radial height (h) is approximately 12 inches, the arc radius may be approximately 15 inches. It is understood that other relationships between the radial height and arc radius are also possible. As is known in the field of mathematics, the radius of an arc may be approximated using the measurements of arc height (h) and arc width (w) along with the following formula: $r_a=(h/2)+(w^2/8h)$; where "h" is the height measured at the midpoint of the arc's base, and where "w" is equal to the length (width) of the chord defining the base of the arc. In one embodiment, the height (h) may range from approximately 0.5 centimeters to approximately 10 centimeters. In one embodiment, the width (w) may range from approximately 4 centimeters to approximately 40 centimeters. In any case, the leading edge 12 of static nozzle airfoil 10 is arcuate concave. That is, in contrast to conventional static nozzle airfoils having flat or arcuate convex leading edges, static nozzle airfoil includes an arcuate void across a portion of its leading edge (arcuate void described with reference to FIG. 2).

Figure 4:
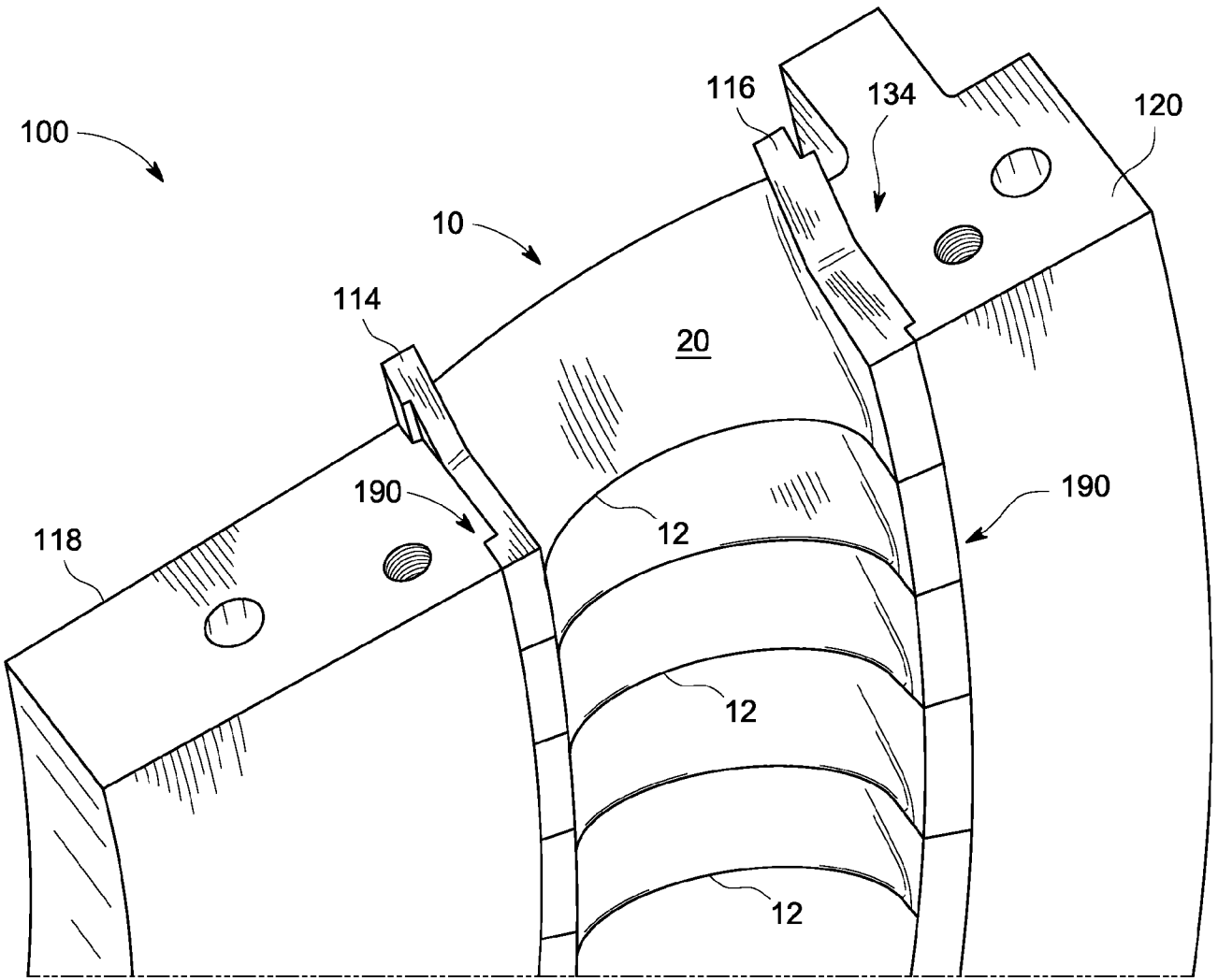
FIG. 4 shows a three-dimensional perspective view of a portion of a turbine static nozzle blade assembly according to an embodiment of the invention.

Turning to FIG. 4, a partial three-dimensional perspective view of a turbine nozzle assembly 100 is shown according to an embodiment of the invention. As shown, turbine nozzle assembly 100 includes static nozzle airfoils 10 have arcuate concave leading edges 12. Also shown are sidewalls, e.g., a first sidewall 114 integral with a first side of leading edge 12 (at peripheral point (Ple), FIG. 2) and a second sidewall 116 integral with a second side of leading edge 12 (at a point opposite peripheral point (Ple)). Sidewalls 114, 116 may be, e.g., welded, brazed, or otherwise attached to sides of static nozzle airfoil(s) 10, as is known in the art. First sidewall 114 may be an inner sidewall (radially inward with respect to a turbine axis), and may be operably attached to an inner ring 118 at a joint 190, via, e.g., welding, brazing clamping or otherwise affixing. Second sidewall 116 may be an outer sidewall (radially outward with respect to a turbine axis), and may be operably attached to an outer ring 120, via, e.g., welding, brazing, clamping or otherwise affixing. Successively placed sidewalls, such as second sidewalls 116, may be arranged substantially flush against one another at interfaces 134.

Figure 5:
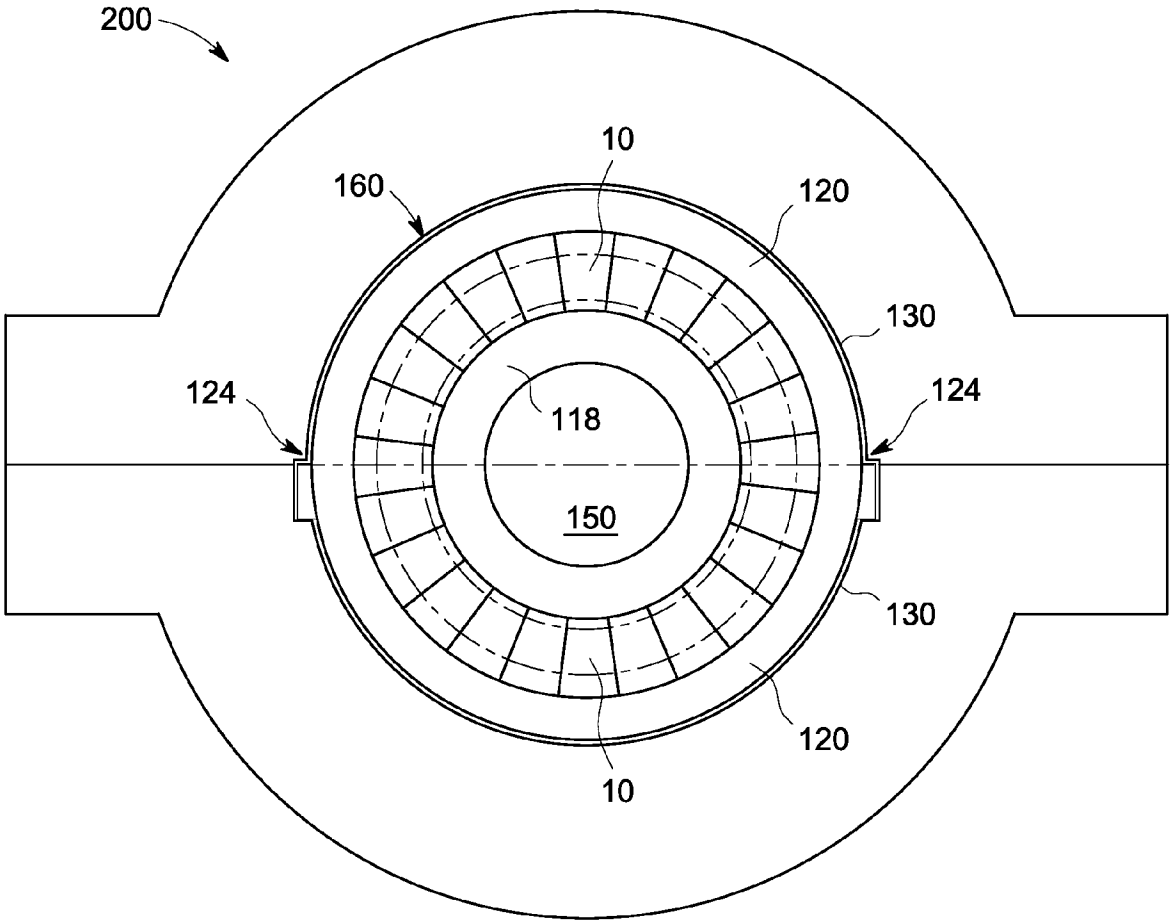
FIG. 5 shows a general schematic end elevation of an apparatus according to an embodiment of the invention.

Turning to FIG. 5, a general schematic end elevation of an apparatus 200 including static nozzle airfoils 10 is shown. Apparatus 200 may be a part of a turbine assembly, e.g., a steam turbine assembly, and may include a casing 130 (upper and lower casing labeled collectively) a turbine rotor 150 at least partially surrounded by casing 130, and a diaphragm assembly 160, including ring segments (e.g., inner ring 118 and outer ring 120) and an annulus of static nozzle blades 10, the diaphragm assembly 160 at least partially surrounding rotor 150. Apparatus 200 is shown also including a horizontal joint surface 124, at which upper portions of casing 130 and diaphragm assembly 160 are joined to form a portion of a turbine assembly, as is known in the art. As shown, apparatus 200 includes static nozzle airfoils 10 having arcuate concave leading edges (not visible), which may allow for increased efficiency of the apparatus 200 (e.g., steam turbine) when compared with apparatuses having conventional static nozzle airfoils. For example, in one embodiment, it has been found that the stage efficiency of a steam turbine may be increased by as much as 0.078 percent using static nozzle airfoils 10 disclosed herein when compared with conventional static nozzle airfoils. In one example, in a steam turbine system having 5 stages, stages 2, 3 and 4 of the steam turbine system experienced increased stage efficiencies of 0.071, 0.068 and 0.078 percent, respectively, using static nozzle airfoils 10 disclosed herein, as compared with the stage efficiencies of these same stages using conventional static nozzle airfoils.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A turbine static nozzle airfoil including:

an arcuate concave leading edge;

a substantially flat trailing edge;

a body portion between the leading edge and the trailing edge, the body portion having a suction side and a pressure side;

wherein the leading edge has an arc radius of approximately three-fourths to approximately four-thirds of a radial height of the leading edge, wherein the leading edge includes a midpoint (Mle) and a peripheral point (Ple) and the trailing edge includes a midpoint (Mte) and a peripheral point (Pte), and a length of an arc (Lm) extending from the midpoint (Mle) of the leading edge across the suction side of the body portion to the midpoint (Mte) of the trailing edge is less than a length of an arc (Lsb) from the peripheral point (Ple) of the leading edge to the trailing edge peripheral point (Pte) across the suction side of the body.

2. The turbine static nozzle airfoil of claim 1, further comprising a pair of sidewalls abutting opposing sides of the arcuate concave leading edge and the substantially flat trailing edge, respectively.

3. The turbine static nozzle airfoil of claim 1, wherein the leading edge is configured to guide a working fluid toward the trailing edge across the body portion.

4. A turbine static nozzle blade assembly comprising:

an airfoil having an arcuate concave leading edge;

a first sidewall integral with a first side of the leading edge;

a second sidewall integral with a second side of the leading edge;

a trailing edge substantially opposing the arcuate concave leading edge; and a body portion between the leading edge and the trailing edge, the body portion having a suction side and a pressure side;

wherein the leading edge has an arc radius of approximately three-fourths to approximately four-thirds of a radial height of the leading edge, wherein the leading edge includes a midpoint (Mle) and a peripheral point (Ple) and the trailing edge includes a midpoint (Mte) and a peripheral point (Pte), and a length of an arc (Lm) extending from the midpoint (Mle) of the leading edge across the suction side of the body portion to the midpoint (Mte) of the trailing edge is less than a length of an arc (Lsb) from the peripheral point (Ple) of the leading edge to the trailing edge peripheral point (Pte) across the suction side of the body.

5. The turbine static nozzle blade assembly of claim 4, wherein the trailing edge is substantially flat.

6. The turbine static nozzle blade assembly of claim 4, wherein the leading edge is configured to guide a working fluid toward the trailing edge across the body portion.

7. An apparatus comprising:

a turbine assembly having:

a casing;

a turbine rotor at least partially surrounded by the casing; and a diaphragm assembly at least partially surrounding the turbine rotor and at least partially surrounded by the casing, the diaphragm assembly including an annulus of static nozzle blades, wherein each of the static nozzle blades includes an airfoil having an arcuate concave leading edge, wherein the airfoil includes:

a substantially flat trailing edge;

a body portion between the leading edge and the trailing edge, the body portion having a suction side and a pressure side;

wherein the leading edge has an arc radius of approximately three-fourths to approximately four-thirds of a radial height of the leading edge, wherein the leading edge includes a midpoint (Mle) and a peripheral point (Ple) and the trailing edge includes a midpoint (Mte) and a peripheral point (Pte), and a length of an arc (Lm) extending from the midpoint (Mle) of the leading edge across the suction side of the body portion to the midpoint (Mte) of the trailing edge is less than a length of an arc (Lsb) from the peripheral point (Ple) of the leading edge to the trailing edge peripheral point (Pte) across the suction side of the body.

8. The apparatus of claim 7, wherein the turbine assembly is a steam turbine assembly.

9. The apparatus of claim 7, wherein the turbine assembly is a gas turbine assembly.

10. The apparatus of claim 7, wherein a circumferential distance from the midpoint (Mle) of the arcuate concave leading edge to the peripheral point (Ple) of the arcuate concave leading edge is approximately one-fourth of a distance along an entire side of the airfoil.

* * * * *